US006259419B1

(12) United States Patent
Monte

(10) Patent No.: US 6,259,419 B1
(45) Date of Patent: Jul. 10, 2001

(54) MULTI-SECTOR BASE STATION ANTENNA SYSTEM OFFERING BOTH POLARIZATION AND SPATIAL DIVERSITY

(75) Inventor: Thomas D. Monte, Lockport, IL (US)

(73) Assignee: Andrew Corporation, Orlando Park, IL (US)

( * ) Notice: Subject to any disclaimer, the term of this patent is extended or adjusted under 35 U.S.C. 154(b) by 0 days.

(21) Appl. No.: 09/569,725

(22) Filed: May 10, 2000

(51) Int. Cl.[7] ..... H01Q 1/12
(52) U.S. Cl. ..... 343/890; 343/893; 455/562
(58) Field of Search ..... 343/890, 892, 343/893, 874; 455/562; 52/40

(56) References Cited

U.S. PATENT DOCUMENTS

| | | | | |
|---|---|---|---|---|
| 5,291,211 | * | 3/1994 | Tropper | 343/890 |
| 5,787,673 | * | 8/1998 | Noble | 52/726.1 |
| 5,872,548 | * | 2/1999 | Lopez | 343/890 |
| 5,999,145 | * | 12/1999 | Niekamp | 343/890 |
| 6,088,003 | * | 7/2000 | Bassirat | 343/890 |

OTHER PUBLICATIONS

*Mobile Antenna Systems Handbook*, Chapter 3, pp. 115–174, Fugimoto et al., 1994.
Skypath™ Base Station Antennas, pp. 3–8 and 21–66, Andrew Corporation, 2/99.

* cited by examiner

*Primary Examiner*—Tan Ho
(74) *Attorney, Agent, or Firm*—Stephen G. Rudisill; Jenkens & Gilchrist

(57) ABSTRACT

A multiple sector cell-site configuration comprises a support frame and a plurality of antennas mounted on the support frame. The antennas include one transmit antenna element and two receive antenna elements for each sector of the multiple sector cell-site. One of the receive antenna elements for each sector of each two adjacent sectors is located in a common housing mounted adjacent a given point on the support frame located substantially along a boundary between the two adjacent sectors. Each of the receive antenna elements mounted in each housing has an offset azimuthal beam directed toward its associated sector, and each of the transmit antenna elements has an azimuthal beam directed toward its associated sector.

28 Claims, 4 Drawing Sheets

MULTI-SECTOR BASE STATION ANTENNA SYSTEM OFFERING BOTH POLARIZATION AND SPATIAL DIVERSITY

FIELD OF THE INVENTION

A new configuration for a multi-sector base station/cell-site is presented.

BACKGROUND OF THE INVENTION

Usually, a three sector cell-site with standard vertical polarization uses space diversity to improve the system reliability (via horizontal space diversity effective gain). This traditional approach often requires nine separate antennas. A newer approach uses three dual slant polarized antennas to give just about the same system reliability, depending on the surrounding environment, using polarization diversity effective gain. One example of this approach is the Microsite™ scheme, offered by Andrew Corporation, the assignee of this invention.

Polarization diversity works best for congested urban areas, but is less efficient for rural and less congested suburban areas. Typically, in less congested areas, the random polarization scattering levels or multipath encountered are relatively lower than in an urban area and often, the polarization diversity gain is minimal.

However, using space diversity usually implies 10 to 20 $\lambda_0$ (the wavelength in free space) spacing between the two receive antennas for each sector in order to achieve meaningful diversity gain. This spacing implies a relatively large, generally triangular-cross-section support frame which can be expected to lead to generally higher windloading problems at the tower. A relatively larger support frame also can have a negative impact on cell-site aesthetics for purposes of obtaining zoning board approval, and the like. Moreover, the large number of antennas (typically nine antennas for a three-sector cell site using space diversity) implies higher windloading on the numerous antennas, as well as a further negative impact on cell-site aesthetics.

Also, the expense of providing and installing individual antenna units is multiplied by the number of antenna units required for a given multi-sector site. In this regard, operators often lease tower space for their antennas, based on the number of antenna units to be installed. Therefore, reducing the number of antenna units required for a given multi-sector coverage, reduces operator expense.

If the triangular antenna support frame can be made smaller for the same effective diversity gain, less wind loaded is expected. Correspondingly, if a fewer number of antennas can be utilized for the same effective diversity gain, less windload with respect to the antennas, better cell-site aesthetics and less overall cell-site expense can be expected.

OBJECTS OF THE INVENTION

Accordingly, it is a general object of this invention to provide a novel and improved multi-sector cell-site configuration which overcomes the above-noted limitations of both the horizontal space diversity approach and the polarization diversity approach.

SUMMARY OF THE INVENTION

In accordance with one aspect of the invention, the antennas are recombined in a scheme using spatial diversity, but requiring fewer than the nine vertical polarized antennas in a typical three sector cell-site configuration using horizontal space diversity.

In accordance with another aspect of the invention a tower-top multi-sector scheme is presented which combines both horizontal space diversity and polarization diversity using just three antenna units. As suggested above, a scheme which offers a combination of polarization and space diversity, may be a useful approach for suburbs and less densely populated areas when the random polarization scattering levels are low, and therefore, the polarization diversity gain is minimal.

In accordance with another aspect of the invention, a multiple sector cell-site configuration comprises a support frame, a plurality of antennas mounted on the support frame, the antennas including at least one transmit antenna element and at least two receive antenna elements for each sector of the multiple sector cell-site, one of the receive antenna elements for each of two adjacent sectors being located in a common housing mounted adjacent a given point on the support frame located substantially along a boundary between the two adjacent sectors, each of the receive antenna elements mounted in each said common housing having an offset azimuthal beam directed toward its associated sector, and each of the transmit antenna elements having an azimuthal beam directed toward its associated sector.

DETAILED DESCRIPTION OF THE ILLUSTRATED EMBODIMENT

Figure 1:
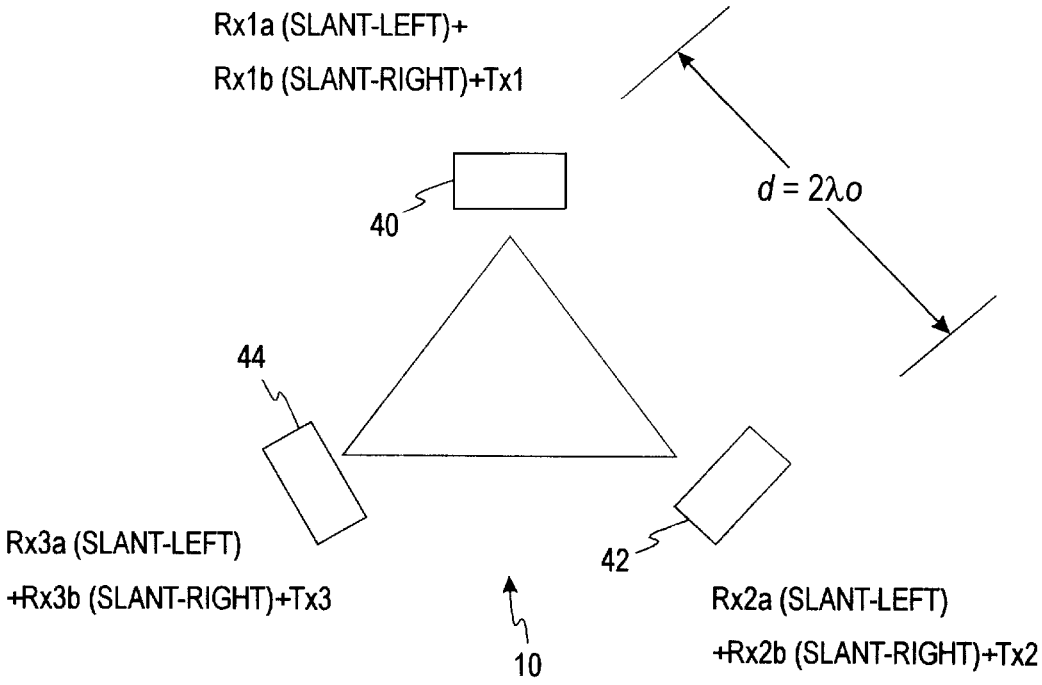
FIG. 1 Prior Art
FIG. 1 is a diagrammatic representation of a prior art three-sector cell-site configuration using polarization diversity.
Figure 2:
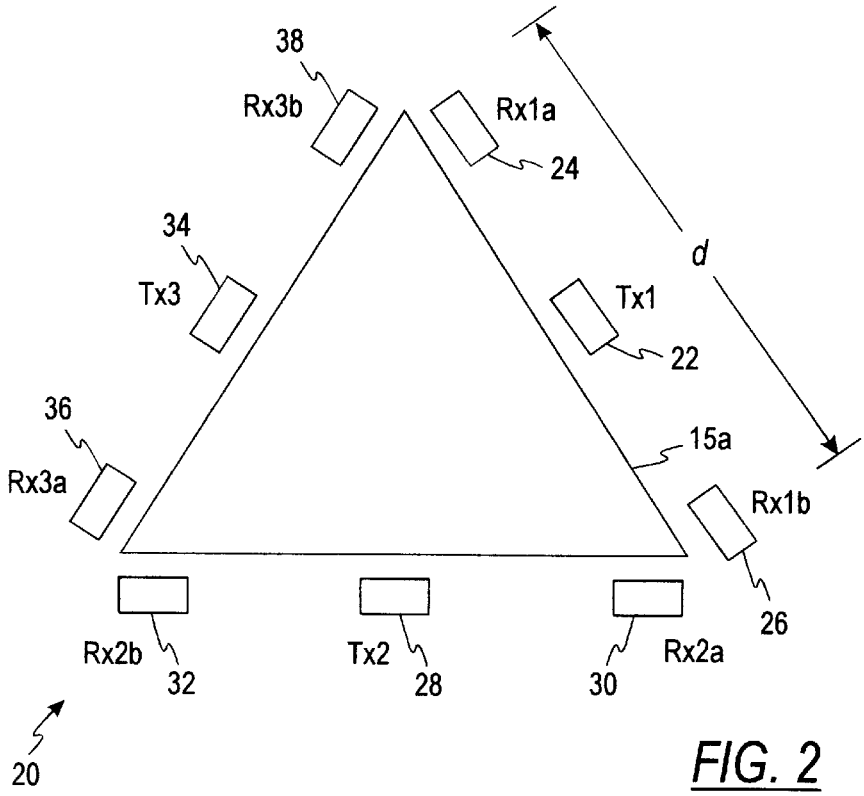
FIG. 2 Prior Art
FIG. 2 is a diagrammatic representation of a second prior art three-sector cell-site configuration using spatial diversity.

Referring now to the drawings, and initially to FIG. 1, a three-sector cell-site configuration utilizing polarization diversity is indicated generally by the reference numeral 10. In FIG. 2, a second prior art cell-site configuration using spatial diversity is indicated by the reference numeral 20. In the configurations of both FIGS. 1 and 2, a support frame having a generally triangular cross-section configuration is utilized, and is designated generally by reference numeral 15 in FIG. 1 and 15*a* in FIG. 2.

In the spatial diversity scheme of FIG. 2, the width d of one side or "face" of the triangular cross-sectional configured support frame 15*a* is on the order of fifteen (15) to twenty (20) times the wavelength in free space ($\lambda_0$), which may be selected at the midband of the band being transmitted/received by the antenna(s). The spatial diversity configuration uses one transmit and two receive antennas at each face, to cover each of three sectors. The transmit antennas in FIG. 2 are designated as Tx1 (22), Tx2 (28) and Tx3 (34). The receive antennas on each face in FIG. 2 are designated, for example, as Rx1*a*(24) and Rx1*b*(26) with respect to the receive antennas for covering sector 1 together with the sector 1 transmit antenna Tx1, and similarly for sectors 2 and 3. It is the spacing of the receive antennas Rx1*a* and Rx1*b* near opposite ends of one face of the support frame 15*a* which achieves the spatial diversity for deriving the desired diversity gain of the received signal. The same scheme is used at each of the other faces as indicated in FIG. 2.

As suggested above, this spatial diversity scheme requires a total of nine separate antenna elements or structures mounted at the respective faces of the support frame 15*a*. This requires a relatively wide faces, as well as a large number of antenna elements which add to windloading considerations, as well as site aesthetics, as discussed above. The number of antennas may be reduced to six, if one of the antennas per sector is used for both receive and transmit through the use of a diplexer.

Two general schemes are currently used. First, a scheme without diplexers places the TX antenna between the two RX antennas and a certain amount of RF isolation is realized from the TX antenna to RX antennas. Since some isolation is realized due to the physical separation of the antennas, less filtering is required. If less filtering is required, then lower RF loss and lower cost filters can be used in the system. This is the system that uses 9 antennas.

In the second scheme, one of the antennas provides both the RX and TX function. In this case, diplexers are required to separate the RX and TX signals at a common port. The advantage is only two antennas per sectors are required.

Referring again to FIG. 1, a narrower support frame face width d on the order of two (2) times the wavelength in free space ($\lambda_0$), can be used when the antenna elements for each sector are combined at support frame corners or apices, using polarization diversity, rather than horizontal spatial diversity, for the receive antennas. Thus, in the embodiment of FIG. 1, the Tx1 antenna is combined with Rx1*a* and Rx1*b* antennas at a first corner or apex of the support frame 15. The Rx1*a* and Rx1*b* antennas have different polarizations, and in one prior art embodiment, have 45° slant-left and slant-right polarizations, respectively, to achieve polarization diversity. As indicated in FIG. 1, a similar scheme is used at each of the other support frame corners or apices with respect to the transmit and receive antennas for sector 2 and sector 3, respectively. The three "combined" antenna units utilized in the prior art embodiment of FIG. 1 (which uses polarization diversity) are indicated generally by reference numerals 40, 42 and 44. As noted above, this polarization diversity scheme works well for congested urban areas but less well for rural and less congested suburban areas.

Figure 3:
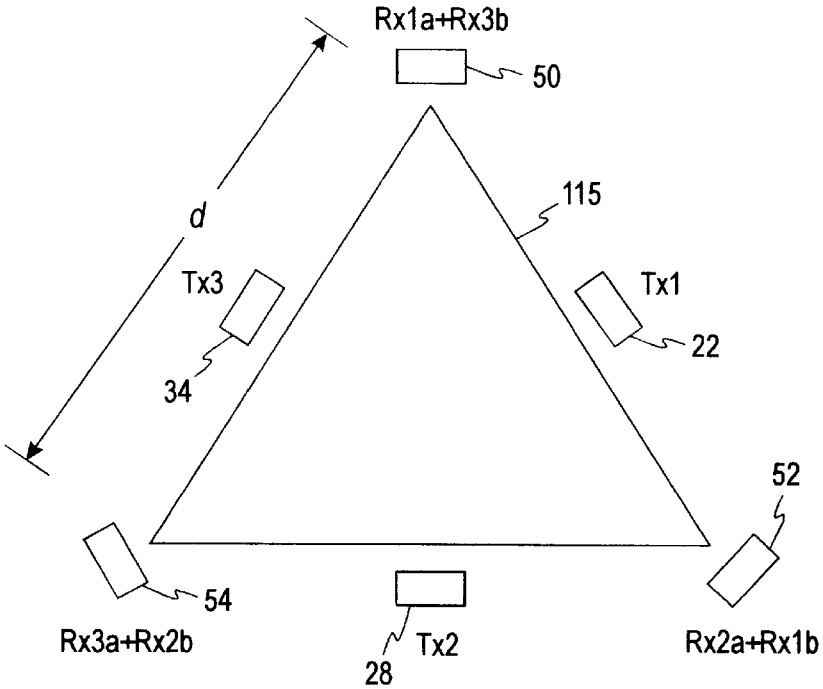
FIG. 3 is a diagrammatic showing of three-sector cell-site in accordance with a first embodiment of the invention, using spatial diversity.

Referring now to FIG. 3, an improvement on the prior art "spatial diversity" scheme of FIG. 2, in accordance with one aspect of the invention, is illustrated. The three-sector cell-site configuration of FIG. 3 includes a similar support frame 115 (d of 15 $\lambda_0$ to 20$\lambda_0$) which is generally triangular in cross-section and respective sector transmit antennas 22, 28 and 34 located in similar fashion to cell-site configuration of FIG. 2. The distance d or width of the faces of the support frame 115 is also similar to that in the configuration of FIG. 2.

Departing from FIG. 2, the respective receive antenna elements are rearranged in respective corners or apices of the triangular support frame configuration in FIG. 3. Specifically, a first antenna unit or housing 50 includes the Rx1*a* and Rx3*b* antennas which are preferably separately aimed or slanted so as to have azimuthal beams directed toward their respective sectors, although housed in a common housing. Similarly, a second antenna unit or housing 52 houses the Rx1*b* and Rx2*a* antennas, again, each appropriately "aimed" toward its respective sector. Finally, the third tower corner mounts an antenna unit or housing 54 which contains Rx3*a* and Rx2*b* antenna elements, each "aimed" toward its respective sector of coverage. Thus, in the embodiment of FIG. 3, by grouping adjacent receive antennas and combining them into a single unit or housing the total number of antenna units in the three-sector cell-site is reduced to six. This embodiment uses only spatial diversity, in view of the horizontal spacing of respective ones of a pair of receive (Rx) antenna elements used for coverage in each sector, for example the Rx1*a* and Rx1*b* antennas located in housings 50 and 52.

Figure 4:
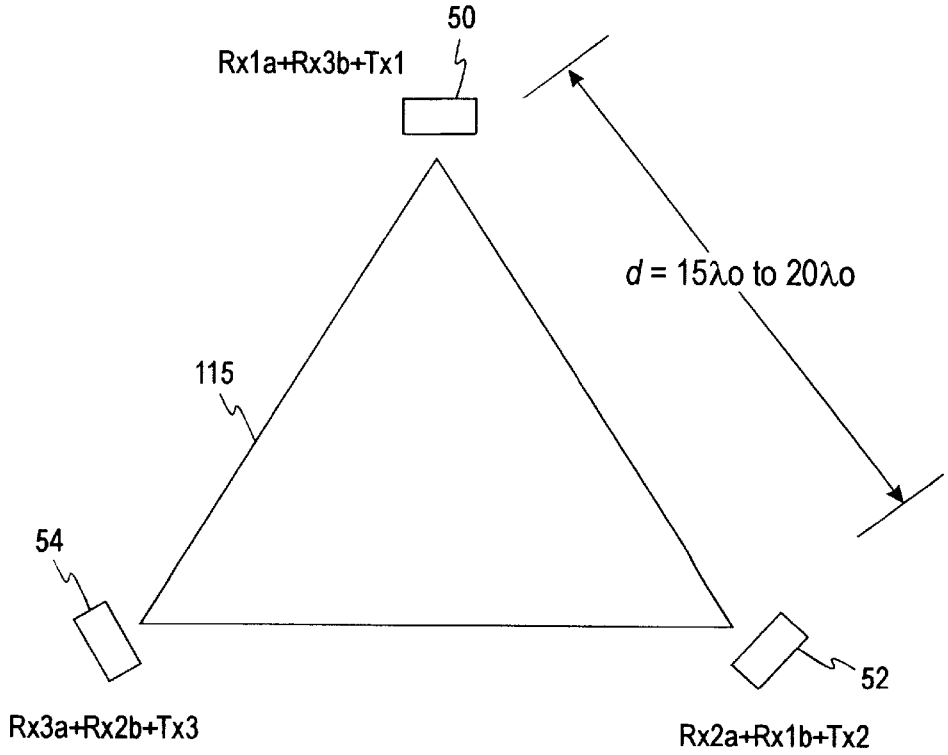
FIG. 4 is a diagrammatic representation of a three-sector cell-site in accordance with a second embodiment of the invention, using spatial diversity.

Referring now to FIG. 4, the number of antenna units can be reduced to three units or housings with the additional use of frequency duplexers, or diplexers as they are sometimes known (not shown). That is, the function of each of the transmit sector antennas may be shared with a receive antenna for the corresponding sector in each of the housings 50, 52 and 54 at the corners of the support frame 115, as indicated in FIG. 4. Here, each of the combined transmit/receive antennas would be appropriately aimed or "beamed" with respect to its desired sector of coverage. It will be noted that in the embodiments of FIGS. 3 and 4, all of the antenna elements have but a single polarization. Thus, only spatial diversity is utilized in both of these embodiments.

Figure 5:
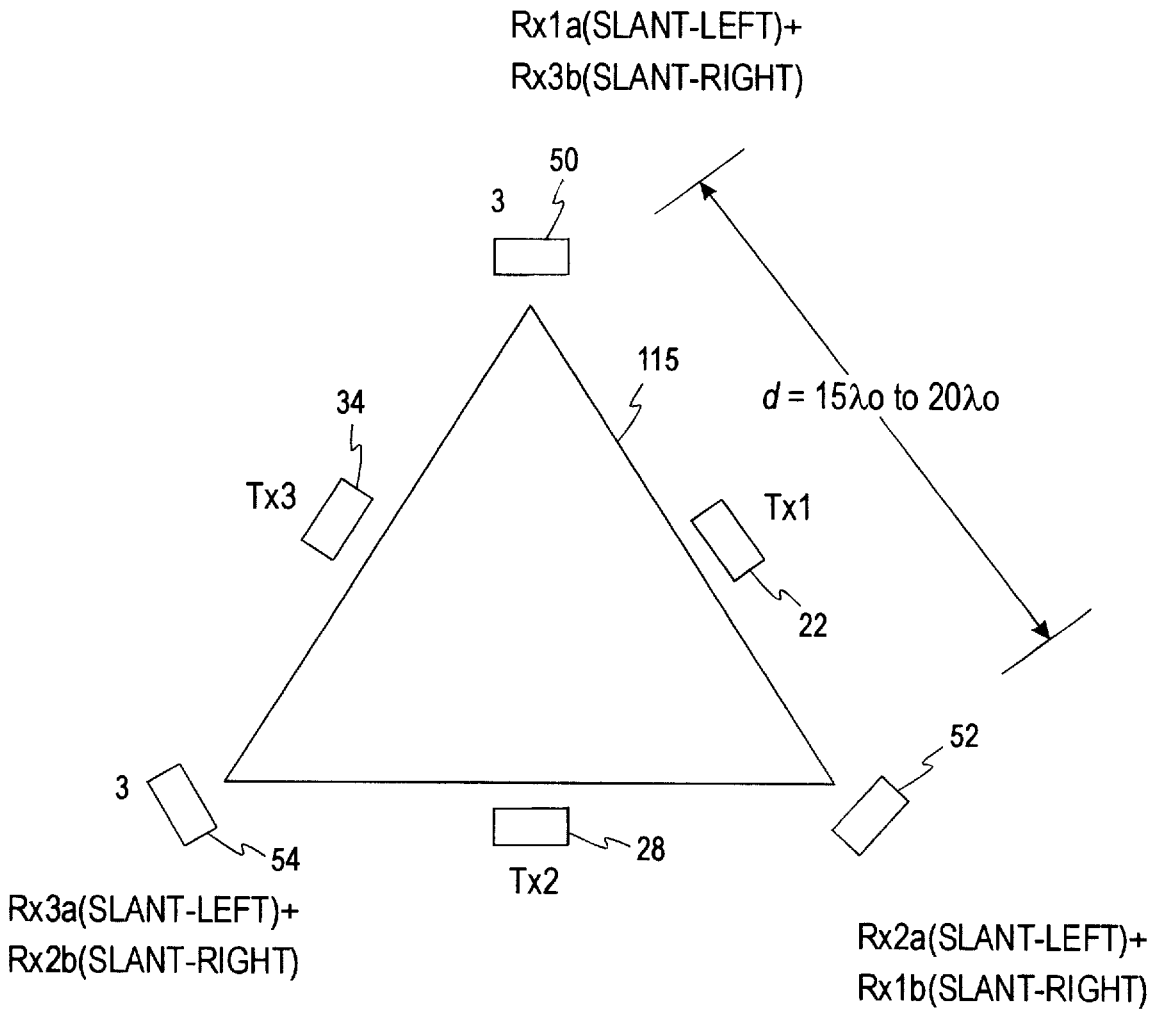
FIG. 5 is a diagrammatic representation of a three-sector cell-site in accordance with another embodiment of the invention, using both spatial and polarization diversity.

Referring now to FIG. 5, a configuration of antennas similar to that in FIG. 3 is illustrated with respect to a similar support frame 115, wherein d is about 15 $\lambda_0$ to 20 $\lambda_0$. In FIG. 5, the transmit sector antennas 22, 28 and 34 are located at the midpoint of each face in similar fashion to FIG. 3. At the corners of the support frame 115, the same antenna housings or packages 50, 52 and 54 house the same combinations of sector receive antennas "aimed" in the same fashion as shown and described above with reference to FIG. 3. Thus, spatial diversity is also achieved for the receive antennas in FIG. 5.

Departing from the embodiment of FIG. 3, in FIG. 5, polarization diversity is utilized as well. While the transmit antennas 22, 28 and 34 remain vertically polarized, the respective receive antennas have different polarizations for the two antennas associated with each sector. Thus, for example, the Rx1*a* and Rx1*b* antennas (of unit 50 and unit 52) will have different polarizations. In the embodiment described herein, the Rx1*a* antenna has a 45° slant left polarization while the Rx1*b* antenna has a 45° slant right polarization. In similar fashion, the Rx2*a* and Rx3*a* antennas have a 45° slant left polarization, while the Rx2*b* and Rx3*b* antennas have a 45° slant right polarization. Accordingly, the embodiment of FIG. 5, advantageously achieves both spatial diversity and polarization diversity while using a total of only six antenna units or housings.

Figure 6:
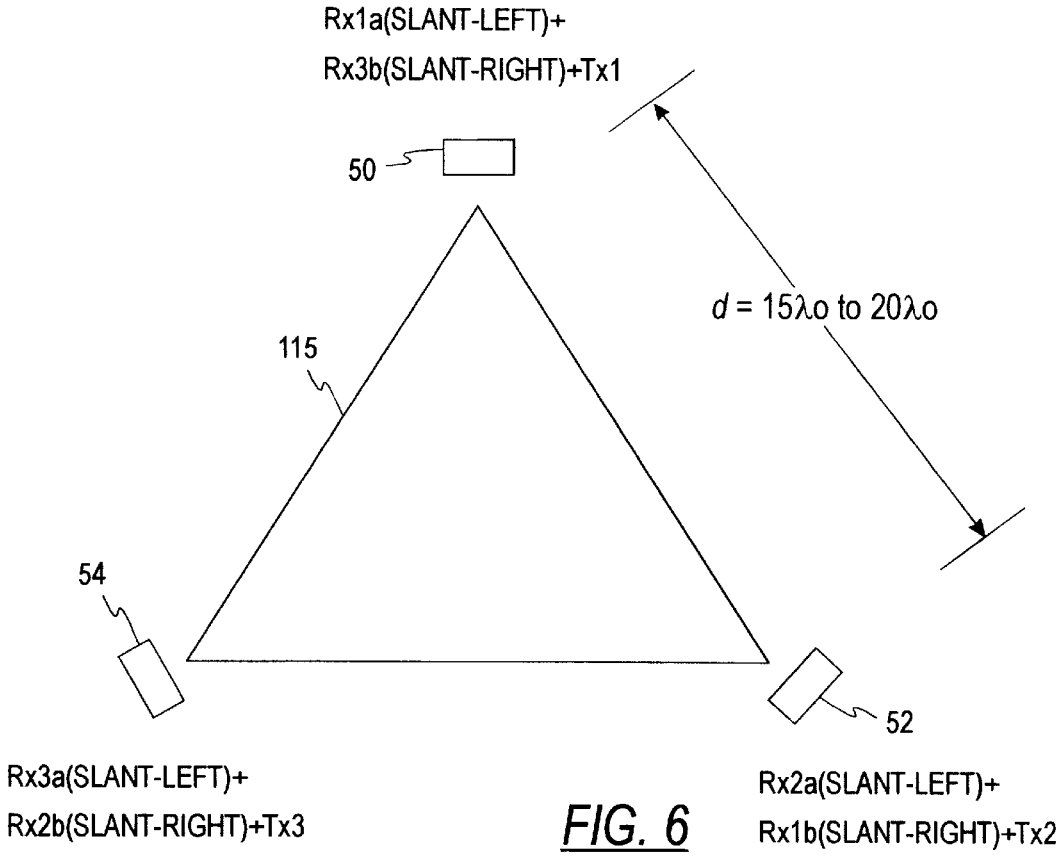
FIG. 6 is a diagrammatic representation of a three-sector cell-site in accordance with a further embodiment of the invention, using both spatial and polarization diversity.

Referring to FIG. 6, on a like-configured support frame 115 (d between 15 $\lambda_0$ and 20 $\lambda_0$), the antenna housings or units can be reduced to a total of three, comprising the housings 50, 52 and 54 by combining (as in FIG. 4) the transmit antenna function for each sector with one of the receive antennas for that sector. This is done as generally indicated in FIG. 6, with the Tx1 antenna being realized in the housing 50, the Tx2 antenna function being realized in the housing 52 and the Tx3 antenna function being realized in the housing 54. Thus, the embodiment of FIG. 6 reduces to a total of three antenna units or housings, with the use of duplexers or frequency diplexers (not shown), as they are sometimes known, similar to the use of duplexers in the embodiment of FIG. 4, to accommodate combined transmit/receive antenna elements.

Figure 7:
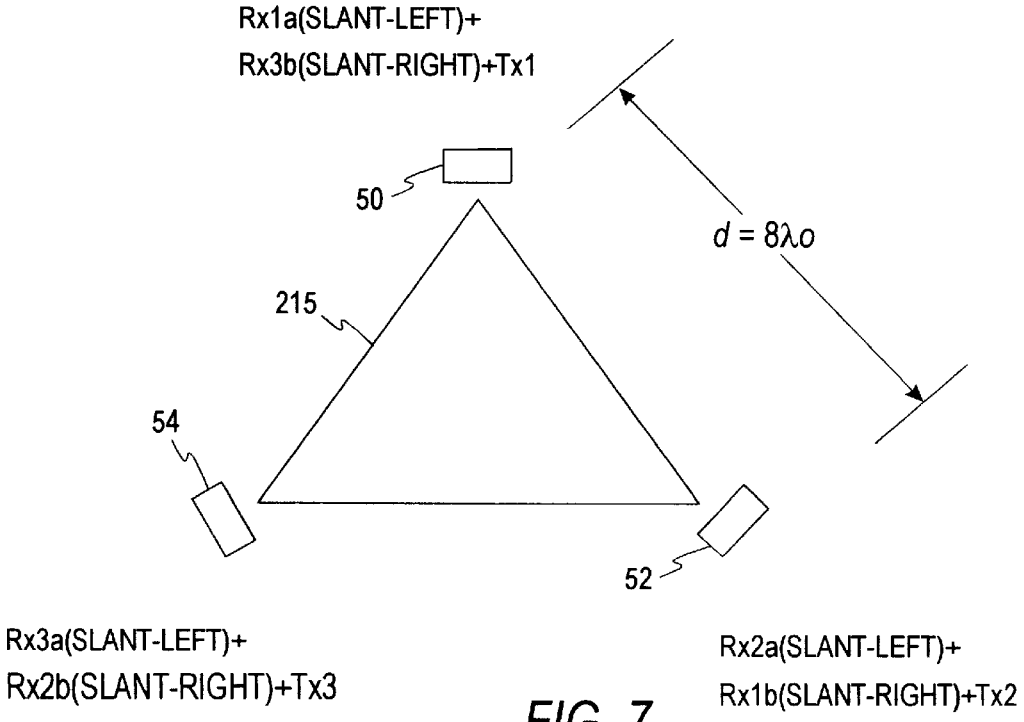
FIG. 7 is a diagrammatic view of an alternate embodiment of the configuration illustrated in FIG. 6.

In FIG. 7, the same antenna element arrangement with respect to housings 50, 52 and 54 as in FIG. 6 is illustrated in connection with a support frame 215 which has a shorter face width d, in this case, of eight (8) times $\lambda_0$. In this configuration, by using polarization diversity together with spatial diversity, a smaller cross-section support frame, providing lesser spacing between the diversity and receive antenna elements can be utilized for performance (diversity gain) comparable to that for the wider prior art support frame of FIG. 2, for example.

Considerable savings in costs of materials and installations can be realized with the novel configurations in accordance with the invention as described above. For example, in the configuration of FIGS. 3 and 5, a total of three transmit antenna units and three receive antenna units can service a three-sector cell-site, requiring nine cable runs. In the configurations of FIGS. 4, 6 and 7, a total of three antenna units or housings are required, with six cable runs, to service a three-sector cell-site.

The three-sector cell-site principles and embodiments illustrated herein may be extended to cell-sites with different numbers of sectors, for example to a six (6)-sector cell-site or any other cell-site having N sectors.

In each of the embodiments of the invention described above, a single housing or unit at each apex or corner of the support frame accommodates antennas for servicing two sectors, having two azimuthal beams with a 120° offset for a three-sector site, on a triangularly cross-sectional configured frame. These offset angles may be adjusted as will be apparent, to service an N sector site where the number of degrees of arc separating sectors is less than 120° (or greater in the case of two-sector cell-site).

Other variations may be made in the embodiments described above without departing from the invention. For example, the support frame configuration need not be triangular or polygonal but may be circular or otherwise configured, with the horizontal spacing between antenna elements and the locations or azimuth beam directions of respective antenna elements being as described in the above embodiments, or as required, with respect to azimuthal beam directions, for multiple sectors cell-sites having numbers of sectors other than three.

While particular embodiments and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

What is claimed is:

1. A multiple sector cell-site antenna configuration for mounting to a tower, comprising:

a support frame;

a plurality of antenna elements mounted on said support frame;

said antenna elements including one transmit antenna element and two receive antenna elements for each sector of said multiple sector cell-site;

one of the receive antenna elements for each sector of each two adjacent sectors being located in a common housing mounted adjacent a given point on said support frame located substantially along a boundary between said two adjacent sectors and each of said receive antenna elements mounted in each housing having an offset azimuthal beam directed toward its associated sector;

each of said transmit antenna elements having an azimuthal beam directed toward its associated sector; and whereby the two receive antenna elements for each sector are mounted in housings adjacent different ones of said boundaries to achieve spatial diversity.

2. The cell-site of claim 1 wherein the same antenna element performs the function of both the transmit antenna for each sector and one of the receive antennas elements for that sector, and is mounted in one of said common housings.

3. The cell-site of claim 1 wherein the receive antenna elements mounted in each housing are polarized differently from each other.

4. The cell-site of claim 3 wherein the polarization of said receive antenna elements mounted in each housing is a dual slant polarization.

5. The cell-site of claim 4 wherein said dual slant polarization comprises 45° right and 45° left polarizations.

6. The cell-site of claim 5 wherein each of said transmit antenna elements has a vertical polarization.

7. The cell-site of claim 3 wherein each of said transmit antenna elements has a vertical polarization.

8. The cell-site of claim 1 wherein each of said transmit antenna elements has a vertical polarization.

9. The cell-site of claim 1 wherein the transmit antenna element for each sector is located midway between the receive antenna elements for that sector.

10. The cell-site of claim 1 wherein said given points on said support frame define apices of an equilateral triangle.

11. The cell-site of claim 1 wherein said two receive antenna elements for each of said sectors are polarized differently from each other to achieve polarization diversity.

12. The cell-site of claim 11 wherein the polarization of said two receive antenna elements for each sector is a dual slant polarization.

13. The cell-site of claim 12 wherein said dual slant polarization comprises 45° right and 45° left polarization.

14. The cell-site of claim 13 wherein the same antenna element performs the function of both the transmit antenna for each sector and one of the receive antennas elements for that sector, and is mounted in one of said common housings.

15. The cell-site of claim 11 wherein the same antenna element performs the function of both the transmit antenna for each sector and one of the receive antennas elements for that sector, and is mounted in one of said common housings.

16. A method of constructing multiple sector cell-site configuration comprising:

mounting a plurality of antenna elements on said support frame;

said antenna elements including one transmit antenna element and two receive antenna elements for each sector of said multiple sector cell-site;

locating one of the receive antenna elements for each sector of each two adjacent sectors in a common housing;

said mounting including mounting said common housing adjacent a given point on said support frame located substantially along a boundary between said two adjacent sectors;

directing azimuthal beams of each of said receive antenna elements located in each said housing toward its associated sector; and directing an azimuthal beam of each of said transmit antenna elements toward its associated sector;

whereby the two receive antenna elements for each sector are mounted in housings adjacent different ones of said boundaries to achieve spatial diversity.

17. The method of claim 16 and further including utilizing one antenna element within each housing as both the transmit antenna element for one sector and one of the receive antenna elements for that sector.

18. The method of claim 16 and further including polarizing said receive antenna elements located in each housing differently from each other.

19. The method of claim 18 wherein the polarization of said receive antenna elements located in each housing is a dual slant polarization.

20. The method of claim 19 wherein said dual slant polarization comprises 45° right and 45° left polarizations.

21. The method of claim 20 and further including utilizing one antenna element within each housing as both the transmit antenna element for one sector and one of the receive antenna elements for that sector.

22. The method of claim 16 and further including polarizing each of said transmit antenna elements in a vertical polarization.

23. The method of claim 16 and further including mounting the transmit antenna element for each sector midway between the receive antenna elements for that sector.

24. The method of claim 16 wherein said given points on said support frame comprise the apices of a triangle.

25. The method of claim 16 and further including polarizing the two receive antenna elements for each of said sectors differently from each other to achieve polarization diversity.

26. The method of claim 25 wherein the polarization of the receive antenna elements for each sector is a dual slant polarization.

27. The method of claim 26 wherein said dual slant polarization comprises 45° right and 45° left polarizations.

28. The method of claim 27 and further including utilizing one antenna element within each housing as both the transmit antenna element for one sector and one of the receive antenna elements for that sector.

* * * * *